US009205317B2

(12) United States Patent
Ragen

(10) Patent No.: US 9,205,317 B2
(45) Date of Patent: Dec. 8, 2015

(54) TRAINING DEVICE TO AID IMPROVING PROPER FORM AND MEASURING DIRECTIONAL ACCURACY WHEN KICKING A FOOTBALL OR SOCCER BALL

(71) Applicant: Peter D. Ragen, Pewaukee, WI (US)

(72) Inventor: Peter D. Ragen, Pewaukee, WI (US)

( * ) Notice: Subject to any disclaimer, the term of this patent is extended or adjusted under 35 U.S.C. 154(b) by 0 days.

(21) Appl. No.: 14/213,863

(22) Filed: Mar. 14, 2014

(65) Prior Publication Data

US 2014/0274483 A1 Sep. 18, 2014

Related U.S. Application Data

(60) Provisional application No. 61/782,196, filed on Mar. 14, 2013.

(51) Int. Cl.
*A63B 69/00* (2006.01)
*A63B 71/06* (2006.01)

(52) U.S. Cl.
CPC ..... *A63B 69/0091* (2013.01); *A63B 69/002* (2013.01); *A63B 2071/0694* (2013.01); *A63B 2225/68* (2013.01); *A63B 2243/007* (2013.01)

(58) Field of Classification Search
CPC ..... A63B 69/002; A63B 69/0091; A63B 2071/0694
USPC ..... 473/145, 423, 438, 428
See application file for complete search history.

(56) References Cited

U.S. PATENT DOCUMENTS 3,439,916 A 4/1969 Kopp
4,261,564 A * 4/1981 Holahan et al. ..... 473/423
4,350,338 A * 9/1982 May ..... 473/423
4,561,661 A 12/1985 Walker et al.
4,641,834 A * 2/1987 Hegedus et al. ..... 482/83
4,949,973 A * 8/1990 Williamson ..... 473/145
5,280,922 A * 1/1994 Jones ..... 473/426
5,435,572 A * 7/1995 Covel ..... 473/423
5,553,855 A 9/1996 Balestrieri
6,475,108 B1 11/2002 Sarenana, Sr. et al.
7,033,289 B2 4/2006 Sharrocks
7,527,567 B2 5/2009 Ohle
7,811,183 B1 * 10/2010 Ohle ..... 473/429

FOREIGN PATENT DOCUMENTS

JP 2004-337233 12/2004
KR 10-2007-0101028 10/2007
KR 1020070101028 * 10/2007

OTHER PUBLICATIONS

PCT/US2014/029215 International Search Report and Written Opinion dated Aug. 14, 2014 (11 pages).

* cited by examiner

*Primary Examiner* — Melba Bumgarner
*Assistant Examiner* — Laura L Davidson
(74) *Attorney, Agent, or Firm* — Michael Best & Friedrich LLP

(57) ABSTRACT

A training device to aid improving proper form and measuring directional accuracy when performing a training kicking. The device includes a base and a ball holder assembly coupled to the base. The ball holder assembly is configured to receive an attachable ball used for performing simulation kicks. A direction pointer is coupled either the ball holder assembly or the ball and is spaced from a direction template that is used to indicate a relative accuracy of the simulation kick. The device also includes a brake assembly that receives the direction pointer during the training kick to bring the ball holder assembly and the ball to a complete stop.

7 Claims, 13 Drawing Sheets

55
17

70
64
82
86
86
16
90
17
84
90
96
56
57
60
14
54
52
48
50
13
71
26
18
62
88
94
65
92
28
62
22
27
33
32
25
35
32
33
20
18

36
40
44
46
41
42

12
18
21
22
20
34
40
38
44
39
41
42
36
73

FIG. 9
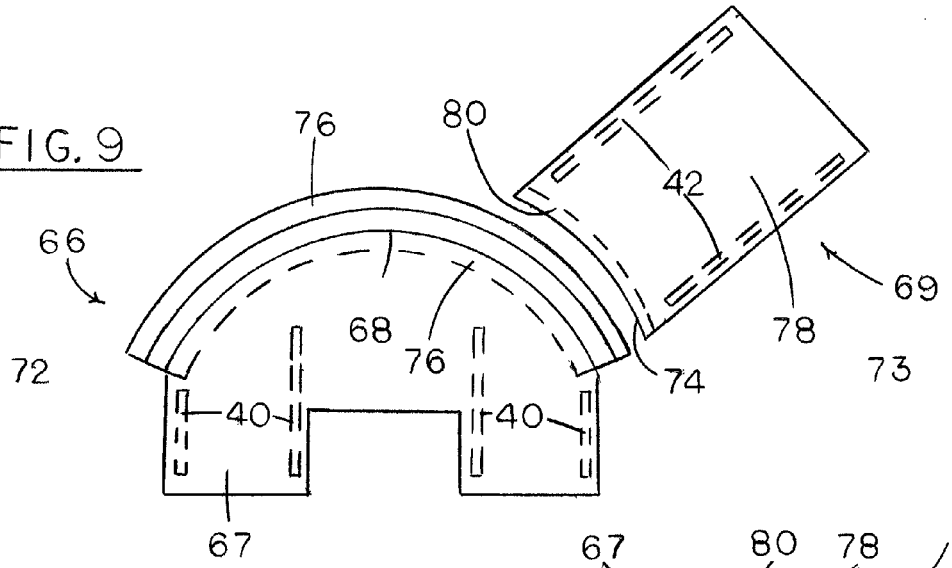
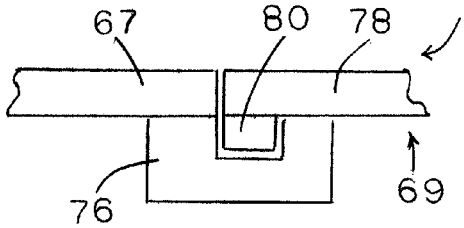
FIG. 10

70
71
72
73
148
150
153
155
156
157
159
160
164
165
166
167
169
170
171
176
182
184
186
187
188
189
190
191
17
0 1 2 3 2 1 0

TRAINING DEVICE TO AID IMPROVING PROPER FORM AND MEASURING DIRECTIONAL ACCURACY WHEN KICKING A FOOTBALL OR SOCCER BALL

CROSS REFERENCE TO RELATED APPLICATIONS

This application is a non-provisional application of U.S. Provisional Application No. 61/782,196, filed on Mar. 14, 2013. The entire contents of which are hereby incorporated by reference.

BACKGROUND

The present invention relates to a training device for measuring directional accuracy when kicking a ball.

The two styles of kicking a football are: (1) to use a straight-line approach to the ball, where the kicker, ball and goal posts are in line, as the ball is kicked with the toe; and (2) to use the soccer-style approach, where the player kicks with the instep of his foot.

Kicking with the toe is generally used in youth football (i.e., eighth grade and below). As kickers progress to high school, college, and beyond, where more training is available, there has been a change to the soccer-style kick.

To get maximum effect of a soccer-style kick, the approach to the ball is at an angle to a line connecting the ball and the goal posts. To get more power and distance, the kicker tilts his body sideways away from the ball and at the same time twists his body to get more momentum as he follows through with his kicking leg. Since he is kicking the ball with his instep, the ball is typically tilted sideways in the opposite direction in which he tilts his body.

Training devices for improving kicking are known. Some representative examples are disclosed in U.S. Pat. Nos. 5,435,572, 4,641,834, and 4,516,769. The training devices described in these patents include a moveable part holding a ball or simulated ball, which moves from front to rear, but returns to its starting point, before the kick, without stopping. These devices have no means of showing accuracy or inaccuracy in a practice kicking session. There is no evidence or way of determining if the practice kick would have been on or off target.

SUMMARY

The training device as described herein improves proper kicking form by measuring the directional accuracy of a kick. The training device provides immediate feedback to the kicker indicating the direction the ball was kicked, as well as information relating to whether the kick would have been a successful field goal from a particular distance on a football field. The present invention relates to a training aid device used to learn and improve proper form, and measure directional accuracy when kicking to an imaginary target with a football or soccer ball, as well as an exercise device used for strengthening leg muscles.

The training device can hold a football, soccer ball, or a simulated foam football or soccer ball in a position for kicking. There may be a support rod that can be attached to the device to help the kicker balance himself while standing as he brings his other foot back and kicks the ball.

The ball holder moves from the front of the device to the rear of the device when kicked. As it travels, it moves in the direction in which the force of the foot directs it except in cross over kicks. When the ball is kicked on the right side, the ball ends up on the left. When the ball is kicked on the left side, the ball ends up on the right side. On a center kick, the ball ends up in the center.

As the ball moves to the rear, a direction pointer enters the braking mechanism between two brake pads on the rear structure. This slows the ball assembly down as the stop bumper, on the ball holder, impacts the rear structure. A direction template is mounted on the brake pad where the direction pointer enters and stops. By observing the relationship between the direction pointer and direction template, the kicker can determine his success or failure of the accuracy of his kick, and then evaluate the options in his training. The ball is returned to the start position by the kicker.

The kicking device may also allow the kicker to change the angle of the football from a vertical position to a sideways slanting position.

One embodiment of the device to perform a practice kick includes a platform where one foot of the kicker remains on the platform while the other foot kicks the ball. This device has a short distance for the ball and ball holder assembly to travel. As a result the kicker's foot remains on the ball during the practice kick, until it is stopped by a braking mechanism. It can be used by trainees or more advanced kickers to improve their kicking, indoors or outdoors, as they have the opportunity to gauge their practice kicks.

Another embodiment for a kicking device has a longer travel for the ball and ball holder assembly to travel from front to the rear stop. It can include a platform and one or two walkways to be connected to the platform. The kicker uses a platform and one walkway for a one-step approach to the platform, or two walkways for a two-step approach to the platform. After the approach the kicker sets one foot on the platform and performs a full follow through kick. The longer travel of the ball to the rear of the device allows the kickers foot to leave the ball. This would be a realistic training kick for the kicker to kick a field goal. This device should be used by soccer-style kickers who are trained to kick a soccer ball or a football. It can be used indoors, outdoors, in season or out of season to improve the accuracy of their kicks.

A third embodiment of a training device to kick a soccer ball could be adapted to train boys and girls in elementary schools, as well as older beginners and experienced kickers. The device is compact and light weight and consists of a guide assembly, with slots, connected to a base board, a ball connected to a direction pointer slides through the slot when kicked, and stops over a template which shows the accuracy of his kick. A second person stands on the back of the board to hold it from moving, and can instruct the kicker about the different soccer kicks and the accuracy of his kicks. He can also stabilize the kicker, if necessary, by holding his hand during the kick.

Other aspects of the invention will become apparent by consideration of the detailed description and accompanying drawings.

BRIEF DESCRIPTION OF THE DRAWINGS

FIG. 9 is a more detailed top view of a platform, walkway, and base assembly of the FIG. 8.

FIG. 10 is a side view of connecting component parts in FIG. 9.

FIG. 15 is a perspective view of another construction of a kick training device according to the invention.

FIG. 20 is a detailed top view of the device with a platform to kick from.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figures 1, 2, 3:
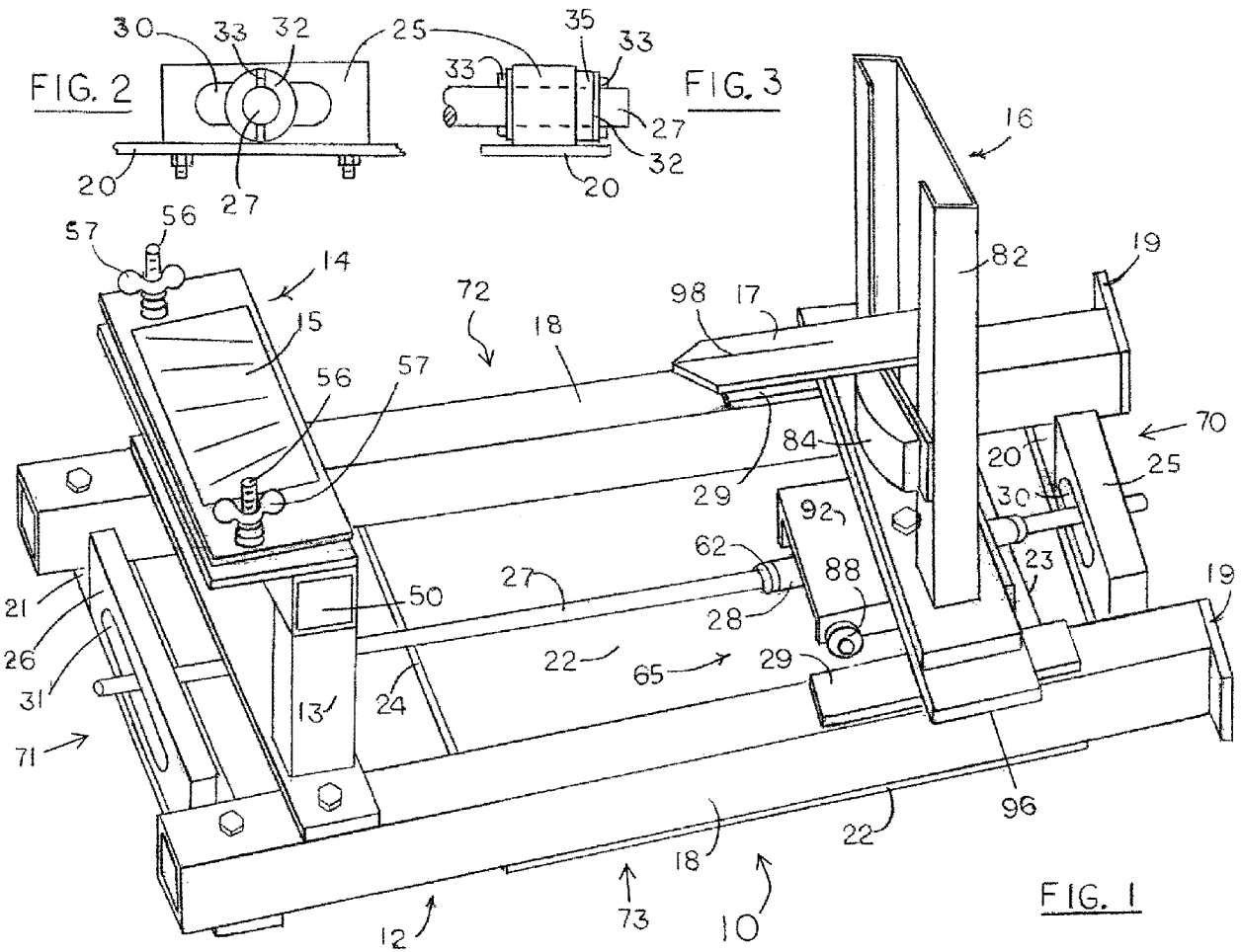
FIG. 1 is a perspective view of one construction of a kick training device according to the invention.
FIG. 2 is a front view portion of a front rod frame of the kick training device in FIG. 1.
FIG. 3 is a side view portion of a front rod frame of the kick training device in FIG. 1.

FIG. 1 illustrates a kick training device 10 including a base assembly 12, a brake assembly 14, a ball holder assembly 16, and a carriage assembly 65. For descriptive purpose, the kick training device 10 and all corresponding components generally have a front side 70 and a rear side 71, as well as a right side 72 and a left side 73. The ball holder assembly 16 is attached to and generally rides on the carriage assembly 65, while additionally being supported by the base assembly 12. The device 10 further includes a guide rod 27, a direction pointer 17 having a pointed tip 171 (FIG. 22), and a direction template 15, which will be described in detail below. The direction pointer 17 together with the direction template 15 define a directional accuracy indicator, which, as will be discussed below, indicates to a user the relative accuracy of a training kick after the training kick has been performed on the kick training device 10.

The base assembly 12 is generally rectangular and includes two side members 18 with two holding bars 19 attached to the front ends. While the base assembly 12 is illustrated to be generally rectangular, it may also be configured in other orientations. For example, the two side members 18 may be slanted such that the base assembly 12 is more of a triangular shape. The base assembly 12 has a front cross member 20, a rear cross member 21, and a base panel 22, which connect the two side members 18 and stabilize the base assembly 12. The base panel 22 generally extends from a front end 23 to a rear end 24 while being connected to the two side members 18 by side portions. Further, the brake assembly 14 is connected to the two side members 18 at the rear of the two side members 18.

A front rod frame 25 is connected to the front cross member 20, and a rear rod frame 26 is connected to the rear cross member 21. The front rod frame 25 has a front a slot 30 and the rear rod frame 26 has a rear slot 31. The guide rod 27 is received within the slots 30, 31 such that the guide rod 27 is free to slide to the left or right when positioned in the slots 30, 31 allowing the ball holder assembly 16 to pivot relative to the base assembly 12. The width of the two slots 30, 31 limits the sideways movement of the guide rod 27 when the ball holder assembly 16 is forced off-center by an off-center kick.

The guide rod 27 is held in place by a plurality of washers 32 and a plurality of dowel pins 33 to prevent the guide rod 27 from moving from side to side or from front to rear. The washers 32 are located on each side of the front rod frame 25 and are held in place by the dowel pins 33 in the guide rod 27. The front rod frame 25 also includes a rubber spacer 35 located between the washer 33 and the front rod frame 25 on the front side 70 thereof.

The ball holder assembly 16 is coupled to a linear bearing 62 and linear bearing tube 28, which are slidably connected to the guide rod 27 to allow the ball holder assembly 17 to linearly move along the guide rod 27.

Figures 4, 17:
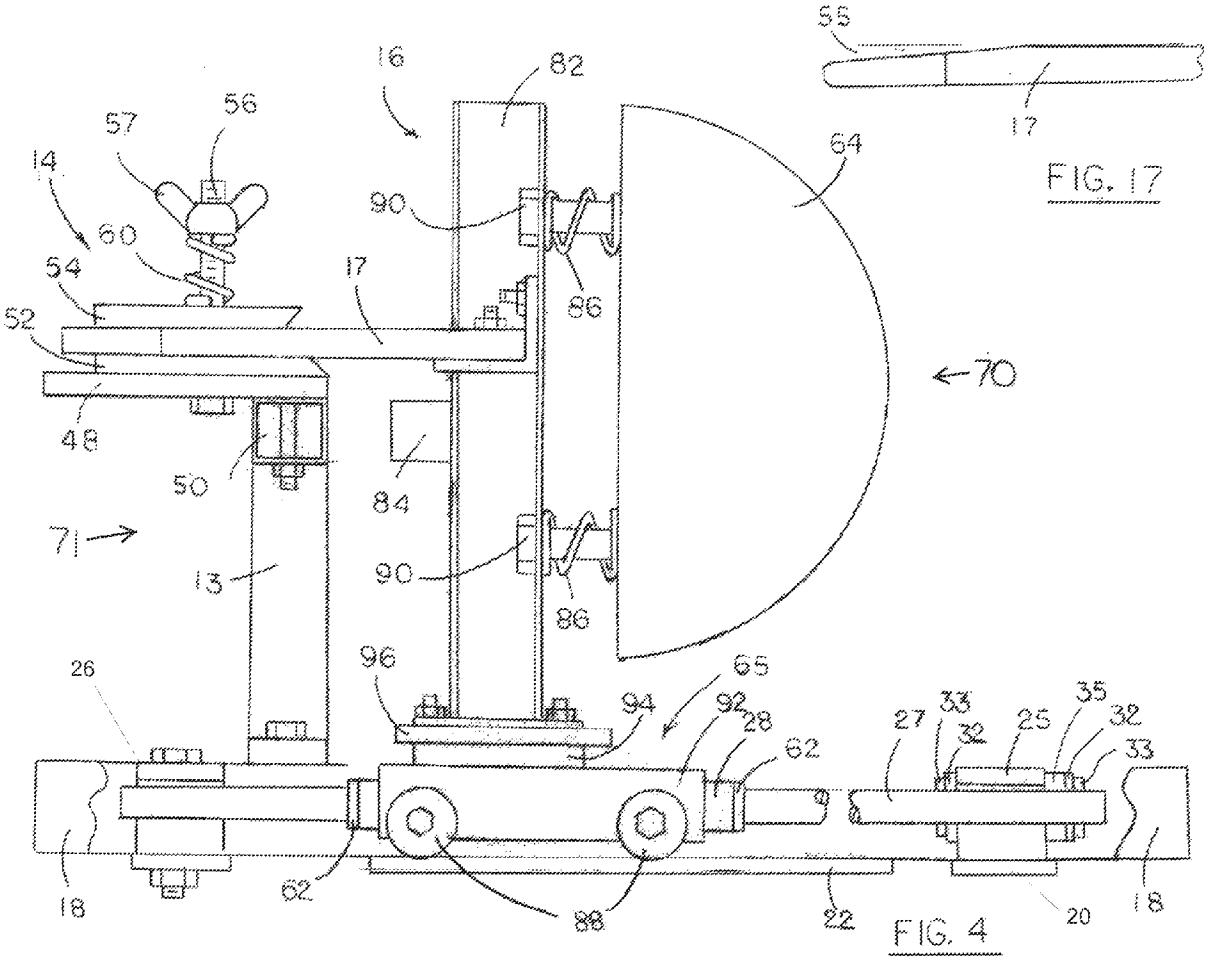
FIG. 4 is a side view of the kick training device in FIG. 1.
FIG. 17 is a side view of a direction pointer similar to the direction pointer in FIG. 4.

As shown in FIG. 4, a foam soccer ball 64 is flexibly connected to the front side of upright 82. Two bolts 90 entering from the rear of the upright 82 connect with two nuts embedded in soccer ball 64. The device 10 may also include ball springs 86 located between the ball 64 and the upright 82.

The ball holder assembly 16 includes a urethane foam ball 64 (e.g., soccer ball, football, etc.) that is flexibly connected to the front side 70 of an upright 82. Two bolts 90 pass through the upright 82 and a set of ball springs 86 to connect with two nuts (not shown) embedded in foam ball 64. In some embodiments, the ball springs 64 are provided as an optional component of the kick device 10.

The ball holder assembly 16 and the carriage assembly 65 are connected to a moveable slide 96, which extends outward to the right and left sides 72, 73 of device 10. The moveable slide 96 extends beyond and sits on top of two stationary slides 29 that are connected to the side members 18. A carriage spacer 94 is provided under the moveable slide 96 to lift the moveable slide 96 up to allow it to lay on the stationary slide 29.

Figures 11, 16:
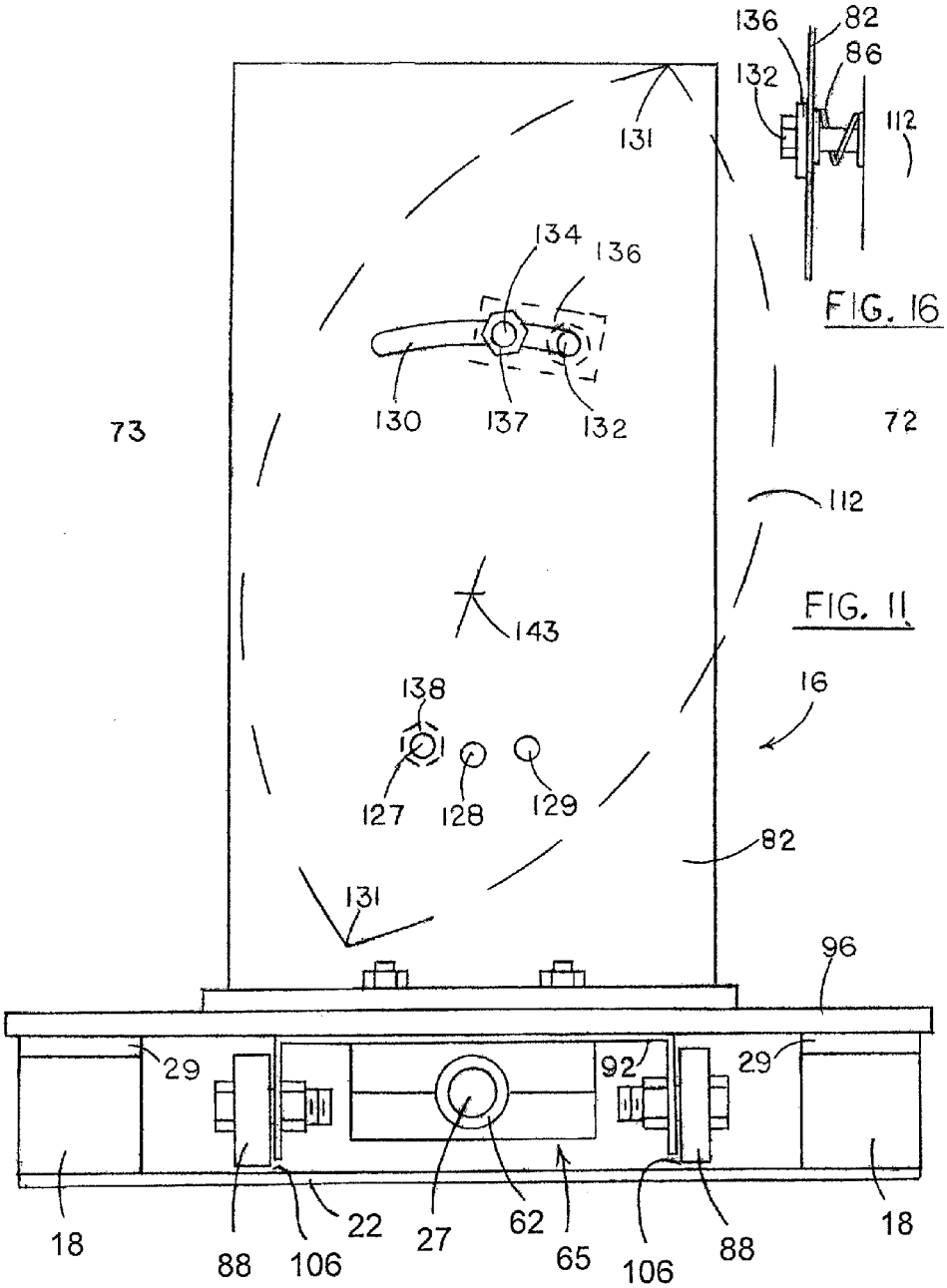
FIG. 11 is a front view of the connection between the upright that holds the football and carriage assembly according to the invention.
FIG. 16 is a side view of the spring and locking bracket in FIG. 11.

The top of the stationary slide 29 is slightly higher than the bottom of the moveable slide 96. As a result, the ball holder assembly 16 and the carriage assembly 65 are lifted up to create a space 106 between the base panel 22 and a set of wheels 88 on the carriage assembly 65, as illustrated in FIG. 11. The moveable slide 96 stabilizes the ball holder assembly 16 and reduces wear and friction when moving over the stationary slide 29. The stationary slide 29 is approximately 6-8 inches long.

As the ball holder assembly 16 moves from the front side 70 to the rear side 71 during a training kick, the moveable slide 96 carries the ball holder assembly 16 and the carriage assembly 65 until the stationary slide 29 ends. At that point, the ball holder assembly 16 drops slightly and the wheels 88 connected to carriage bracket 92 engage the base panel 22.

The wheels 88 allow the holder assembly 16 to continually move rearward after the impact of the training kick. The carriage bracket 92 and the attached linear bearing 62 follow the guide rod 27 as the ball holder assembly moves rearward toward the brake assembly 14 of the training device 10. In this way, the ball holder assembly 16 is movably coupled to the base assembly 12 to allow relative horizontal and pivoting movement while restricting vertical movement. The ball holder assembly 16 and ball 64 translate horizontally relative to the base assembly 12 such that after the ball 64 is kicked the ball 64 maintains a horizontal trajectory throughout the movement of the ball 64 and ball holder assembly 16 from the front side 70 to the rear side 71.

Figure 5:
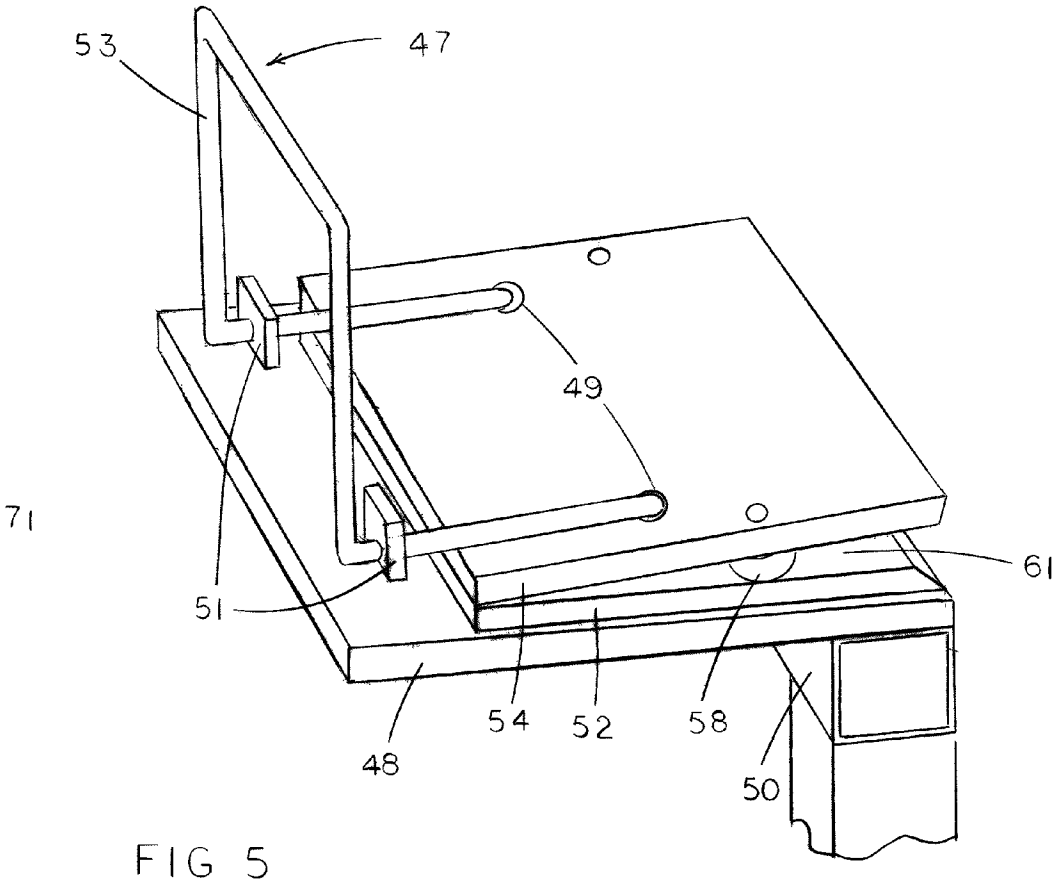
FIG. 5 is a perspective view of the brake pads in FIG. 4.

As illustrated in FIG. 4, a rear structure 13 is connected to the two side members 18. An upper rear cross member 50 is also coupled to a top side of the rear structure 13. The brake assembly 14 includes a brake base 48 attached to the upper rear cross member 50 having a bottom brake pad 52. During normal use of the kicking device 10, the bottom brake pad 52 is stationary and does not move. An upper brake pad 54 is positioned above the bottom brake pad 52 and held in place horizontally by two spring bolts 56 having a space therebetween. The brake pads 52, 54 are separated by a spacer 58 located on the two spring bolts 56 and between the two brake pads 52, 54 to create a brake pad opening 61 (FIG. 5). The opening 61 allows for the insertion of the direction pointer 17 as the ball holder assembly 16 moves from the front side 70 to the rear side 71 in order to slow or stop the ball holder assembly. The upper brake pad 54 moves up and down, vertically, in reaction to pressure applied by the direction pointer 17.

As the direction pointer 17 moves into the brake assembly 14, it comes in contact with the brake pads 52, 54, which puts increasing pressure on the direction pointer 17 as it moves further into the brake assembly 14. The direction pointer 17 may have a bevel 55 at an end entering the brake assembly 14 (FIG. 17) to help guide the direction pointer 17 into the brake assembly 14. Also, the bevel 55 on the direction pointer 17 allows the direction pointer 17 to increase in thickness, which would create more pressure on the direction pointer 17 as it travels further into the brake assembly 14. As the upper brake pad 54 comes into contact with the bevel 55, the upper brake pad 54 tilts to meet the entire surface of the direction pointer 17. As the direction pointer 17 travels into the brake assembly 14, the upper brake pad 54 is continually lifted and a downward force is generated by a brake spring 60.

The pressure generated by the brake pads 52, 54 as the direction pointer 17 is inserted into the opening 61 may be changed by tightening or loosening a thumb nut 57. The thumb nut 57 increases pressure on the brake spring 60 as it is screwed down and lessens pressure when screwed up. The distance traveled by the direction pointer 17 as it enters the brake assembly 14 depends upon the speed of the ball holder 16 and the pressure applied on the direction pointer 17 by the two brake pads 52, 54, as varied by the thumb nut 57.

Figure 14:
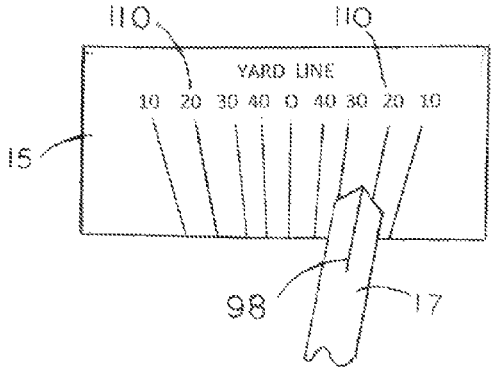
FIG. 14 is another detailed top view of the direction template and direction pointer similar to FIG. 13.
Figure 13:
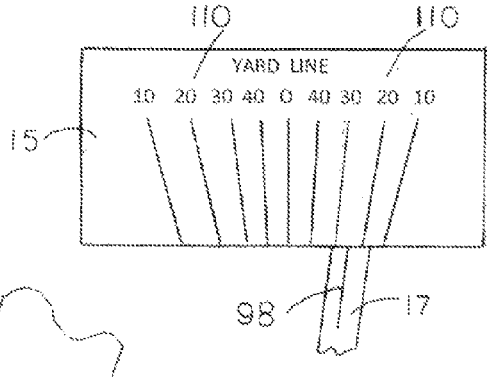
FIG. 13 is a detailed top view of the direction template and direction pointer in FIG. 1.

The kicking device 10 further includes a bumper stop 84 positioned to hit the upper rear cross member 50 in the event that the brake assembly 14 does not completely stop the ball carrier 16. At this point, an indicator line or direction line 98 on the direction pointer 17 is located under the direction template 15, as shown in FIG. 13. Alternatively, the direction line 98 on the direction pointer 17 may be configured to be over the direction template 15, as shown in FIG. 14. In the examples illustrated, the direction line 98 is located between two twenty yard line designators 110 on each side of "0" on the template 15. This indicates to a user, that if a ball was kicked from the twenty yard line, it would be a successful field goal. If the direction pointer 17 was located outside the twenty yard line designators 110, it would have been an unsuccessful field goal attempt.

A brake release 53 in FIG. 5 illustrates how the user or kicker can release the pressure of the brake pads (52, 54) on the direction pointer 17, and move the ball holder 16 to the starting position (i.e., the front side 70). By pushing the brake release 53 at the top of the cross bar 47 toward the backside 71, the brake release 53 will rotate on the two brake release brackets 51 connected to the brake base 48. The ends of the brake release 53 are formed to be loosely connected to the upper brake pad 54, and when properly placed in the two holes 49 on each side of the upper brake pad 54, will also rotate to the upside pulling the upper brake pad 54 up. With one hand on the brake release relieving pressure on the direction pointer 17, and with the other hand the kicker can return the ball 64 and ball holder 16 back to the start position (i.e., the front side) for the next kick. Note that the spring bolt 56 and the brake spring are not shown in this drawing.

FIG. 11 shows a silhouette of a foam football 112 assembled to the ball holder assembly 16, which may be used in place of the soccer ball 64. The foam football 112 is positioned with the top slanted to the right side 72 for a right footed kicker, when kicking soccer style. When the football 112 is kicked, the impact of the instep of the kicker's foot should target a center point 143, which is approximately four to five inches above the bottom of the ball 112 and centered between the left and right sides of the upright 82.

The football 112 is attached to the ball holder assembly 16 using a plurality of bolts. A bolt 132 is fed through a slot 130 and the locking bracket 136. A line drawn through the bolt 132 and the center point 143 locates a lower left bolt hole 127 to the left of a lower center bolt hole 128 for right footed kickers. For left footed kickers, the ball 112 is tilted in the opposite direction, and the line drawn through the bolt 132 and the center point 143 locates a lower right bolt hole 129.

Two embedded nuts in the football 112 are located on a line connecting two end tips 131 of ball 112. The embedded nuts are the same distance apart as the bolt holes 127, 128, 129 and slot 130, as presented in the upright 82. When the ball 112 and upright 82 are assembled together, the impact of a centered kick would impact the center point of the ball 112 and the upright 82.

The ball position bolt 132 is inserted from the rear through the right side hole of the locking bracket 136 and the slot 130 in the ball holder upright 82 to be screwed into a fastener embedded in the foam football 112. The ball spring 86 may be located between the upright 82 and the football 112, as seen with the soccer ball 64. To keep the ball position bolt 132 from moving within the slot 130, another locking bolt 134 would be inserted into a second hole, to the left, in locking bracket 136 from the backside 71 through slot 130 and spring 86 and secured with a nut 137. Another connection is made between the upright 82, the spring 86 and the football 112 at the lower left bolt hole 127. A ball position bolt 138 is placed into the hole 127 and into the embedded nut in the football 112.

To kick from a centered position the bolt at 127 would be moved to center bolt hole 128 with spring 86 and the bolt 132 would be moved to a centered position in slot 130 with spring 86 and connected with a nut embedded in ball 64. The locking bracket 136 would be moved to the left 73 and bolt 134 tightened in place with nut 137. For a left footed kicker, the top of the ball 112 would be slanted to the left by repositioning bolt 132 to the left side 73 with the spring 86. The locking bracket 136 and bolt 134 would be shifted to the right side 72 of bolt 132 and bolt 134 tightened in place.

The addition of the ball spring 86 between the ball 112 and upright 82 lessens the impact force and torque imparted by the kick. The spring 86 also decreases the interaction the force has on the upright 82, the carriage assembly 65, and the guide rod 27.

Figures 6, 7:
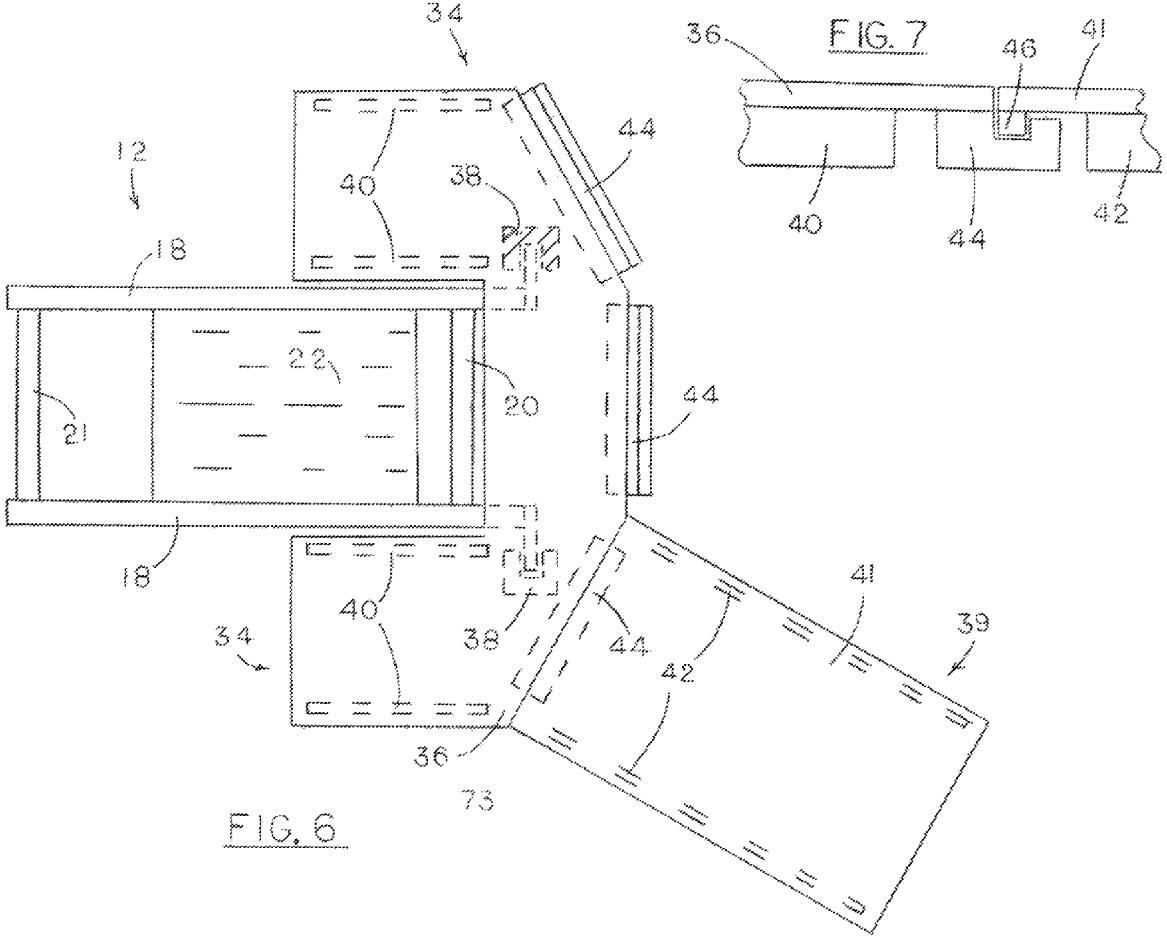
FIG. 6 is a top view of the platform, walkway, and base assembly according to the invention.
FIG. 7 is a side view of connecting component parts in FIG. 6.

FIG. 6 illustrates a platform assembly 34 that sits on top of a portion of the base assembly 12. Additionally, a walkway assembly 39 may be connected to the platform assembly 34. When performing a kick, the device 10 is placed on a flat hard horizontal surface or floor. A platform board 36 is positioned at the front of the base assembly 12 and is lowered so that a plurality of interlock blocks 38 attached to the underside of the platform board 36 surround the holding bars 19 located on base assembly 12. The device 10 and the platform assembly 34 are held together without fasteners and can be easily lifted off.

As shown in FIGS. 6-7, platform feet or lifters 40 and walkway feet or lifters 42 are attached to the underside of the platform board 36 and a walkway board 41 to raise the bottom of the platform board 36 and the walkway board 41 to the same level. The boards 36, 41 rest above the top of the base assembly 12. After the platform assembly 34 is in place, the walkway assembly 39 is lowered into place so that a walkway interlock 46 drops into a holding block 44 that holds the platform 34 and walkway 39 together. Holding block 44 has the same height as the platform lifter 40 and walkway lifter 42.

In another embodiment, a round platform assembly 66 including a round platform edge 68 may be used. Platform lifters 40 and a round holding block 76 are attached to the underside of the round platform board 67. FIG. 9 shows a round walkway assembly 69 including a round walkway board 78 with a round walkway edge 74. The walkway lifters 42 and a round walkway interlock 80 are attached to the underside of the walkway board 78. The height of the platform lifters 40, the walkway lifters 42, and the round holding blocks 76 are approximately the same.

Figure 8:
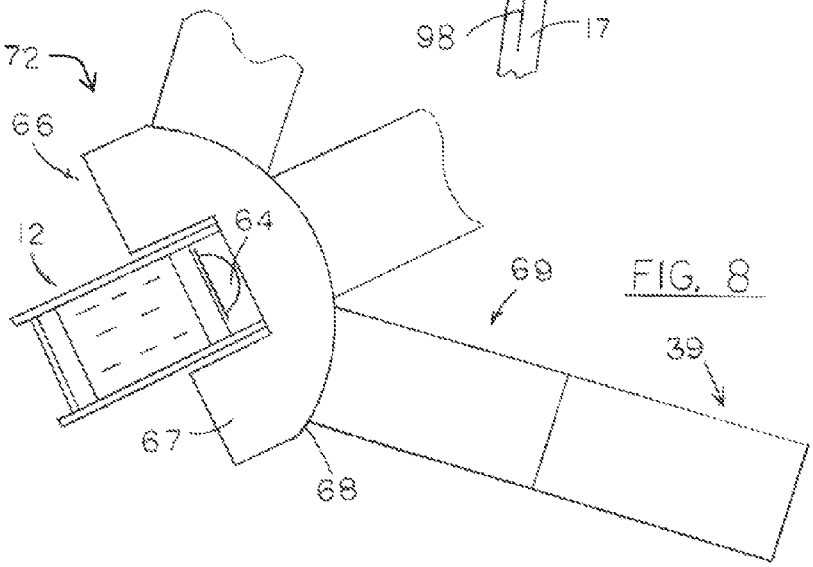
FIG. 8 is a top view of another construction of the platform, walkway, and base assembly according to the invention.

The round platform board 67 is placed on top of the base assembly 12 of the device 10 with the same interlocking relationship as illustrated between the base assembly 12 and the platform board 36 of the embodiment in FIG. 6. FIG. 8 illustrates that the round walkway assembly 69 may be slidably connected, such that it may be moved to any other position along the round holding block 76 to satisfy the user's kick preferences. Additionally, the walkway assembly 39 may be attached to the round walkway assembly 69 with the same connection as illustrated in FIG. 7 to provide additional space for movement of the user. Further, the platform assemblies 34, 66 and the walkway assemblies 39, 69 can be easily removed from the kick training device 10 for storage.

FIG. 15 illustrates another embodiment of the kick training device 10 having a guide bar 114 instead of the guide rod 27. Certain features or elements of the illustrated embodiment are similar to certain feature or elements described in the previous embodiment, the description of which is hereby included by reference. The guide bar 114 has a rectangular cross section and is fixedly connected to the upright 82 and moves with the upright 82 when the ball is kicked. In the illustrated embodiment, the carriage assembly 65 and the linear bearing 62 are not needed and are therefore removed.

A front bar frame 123 can be a one-piece molded plastic or urethane part and is attached to the front cross member 20. The front bar frame includes a slot 124, which limits the sliding movement of the guide bar 114.

FIG. 15 shows a support rod or handle 139 that is used as a stabilizer for a kicker to hold onto as a kick is performed. The support rod 139 is inserted inside a rear upright 140. The support rod 139 can be adjusted up and down and held in place with one or more thumb screws 141 mounted on both of the rear uprights 140.

Figure 12:
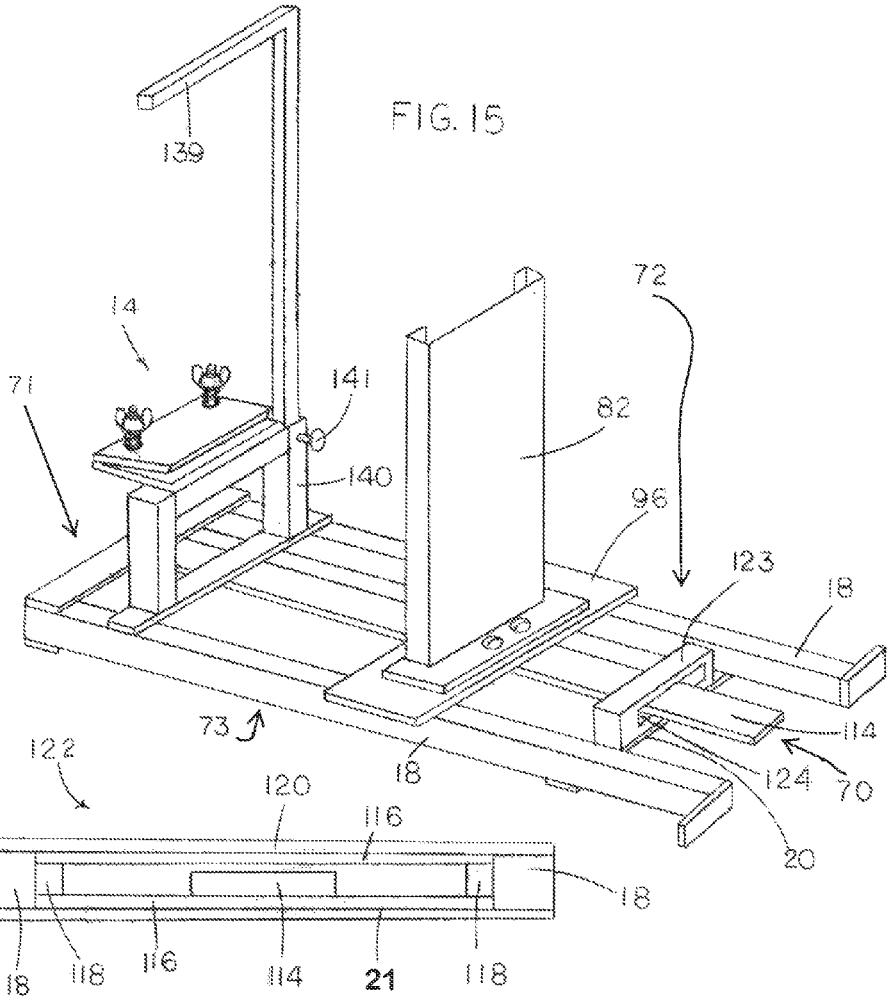
FIG. 12 is a view from the rear to the front of the rear frame assembly in FIG. 15.

FIG. 12 illustrates a rear frame assembly 122, which limits the movement sideways of the guide bar 114 as it moves with the upright 82 from the front 70 to the rear 71. A plastic liner 116 is attached to the bottom of a top cross member 120 and to the top of the rear cross member 21 to prevent wear on the top and bottom of guide bar 114 as it slides therebetween. A slot bumper 118 is attached to each side member 18, between the plastic liners 116. The slot bumpers 118 reduce the impact between the guide bar 114 and the side member 18 if the guide bar 114 strays away from center. In the illustrated embodiment, the kicker's foot remains on the ball until travel is stopped by the brake assembly 14 or the bumper 84.

Figure 18:
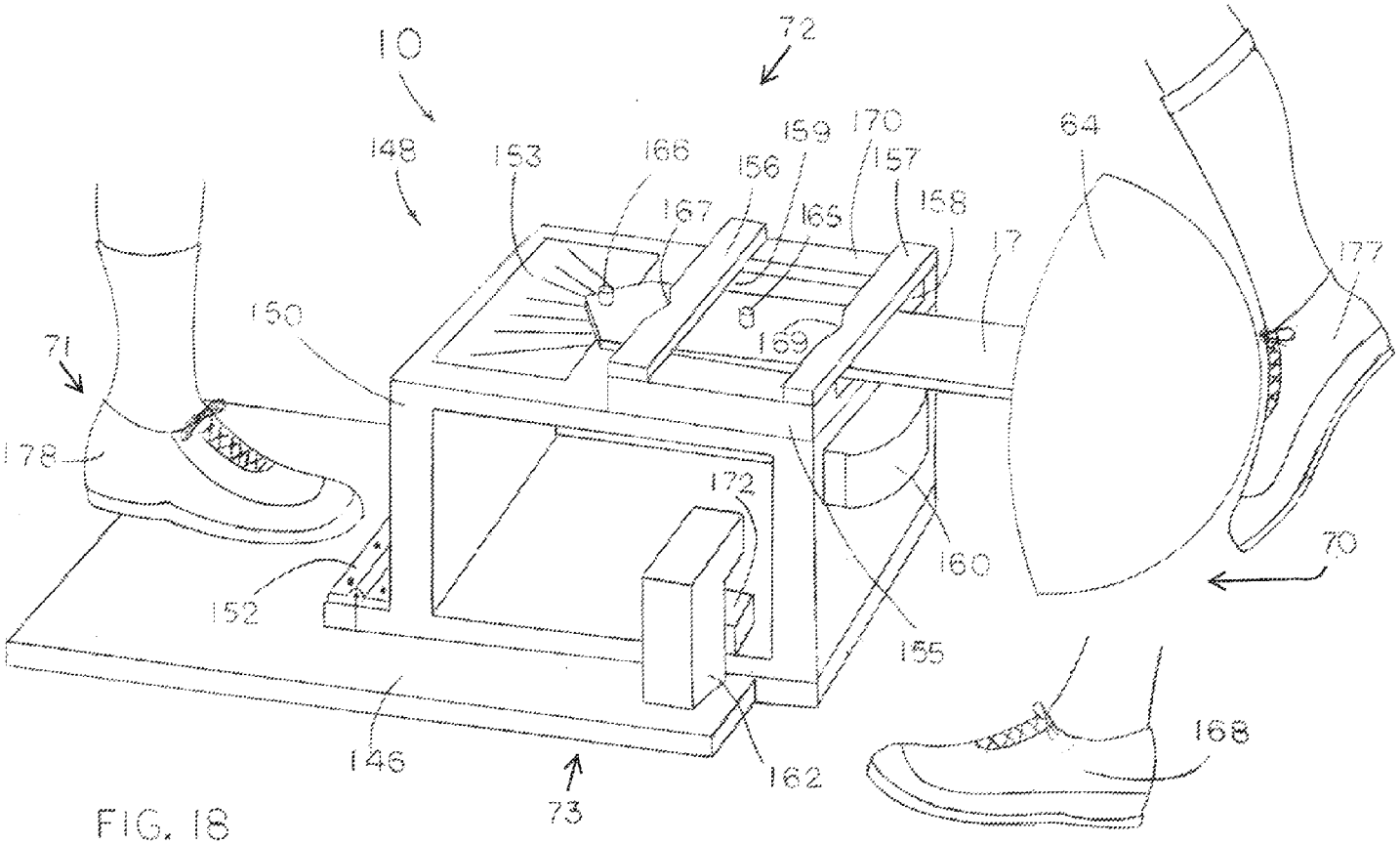
FIG. 18 is a perspective view of another kick training device according to the invention.

Another construction of device 10 is shown in FIG. 18 with a kick structure 150 pivotally connected to the front end of a baseboard 146 by a hinge 152. The hinge 152 allows the structure 150 to swing up and indicate to the kicker that the ball was kicked low. A rotational stopper 162 is provided on each side of the structure 150 to limit the rotation of the structure 150 and prevent the structure 150 from moving sideways. A foam bumper 172 is located between the structure 150 and the stopper 162 to lessen the impact from a low kick.

The device 10 includes a slot base 155 having two slot sides 170. A rear cross bar 156 is attached to the rear ends of the slot sides 170 to form a rear slot 159 on top of slot base 155. Similarly, a front cross bar 157 is attached to the front ends of the slot sides 170 to form a front slot 158 on top of slot base 155. The direction pointer 17 is located within the slots 158, 159 such that it may move freely. The slot base 155 can be rectangular with parallel sides or narrower at the front side 70 than the rear side 71.

FIG. 18 shows a right footed kicker placing their left foot 168 to the left side 73 of the ball 64 and kicking with their right foot 177. During a kick, the foot 177 remains in contact with the ball 64 until it is stopped by a bumper stop 160 attached to the front side 70 of structure 150, to lessen the impact of the kick. A second person holds the kicking device 10 down with their foot 178 on the rear side 71 of the device 10 during the kicking session. Alternatively, or in addition, a weight may also be put on the baseboard 146 to keep the device 10 in place during the kick. In another embodiment, the device 10 may be secured to a level surface.

Figures 21, 22:
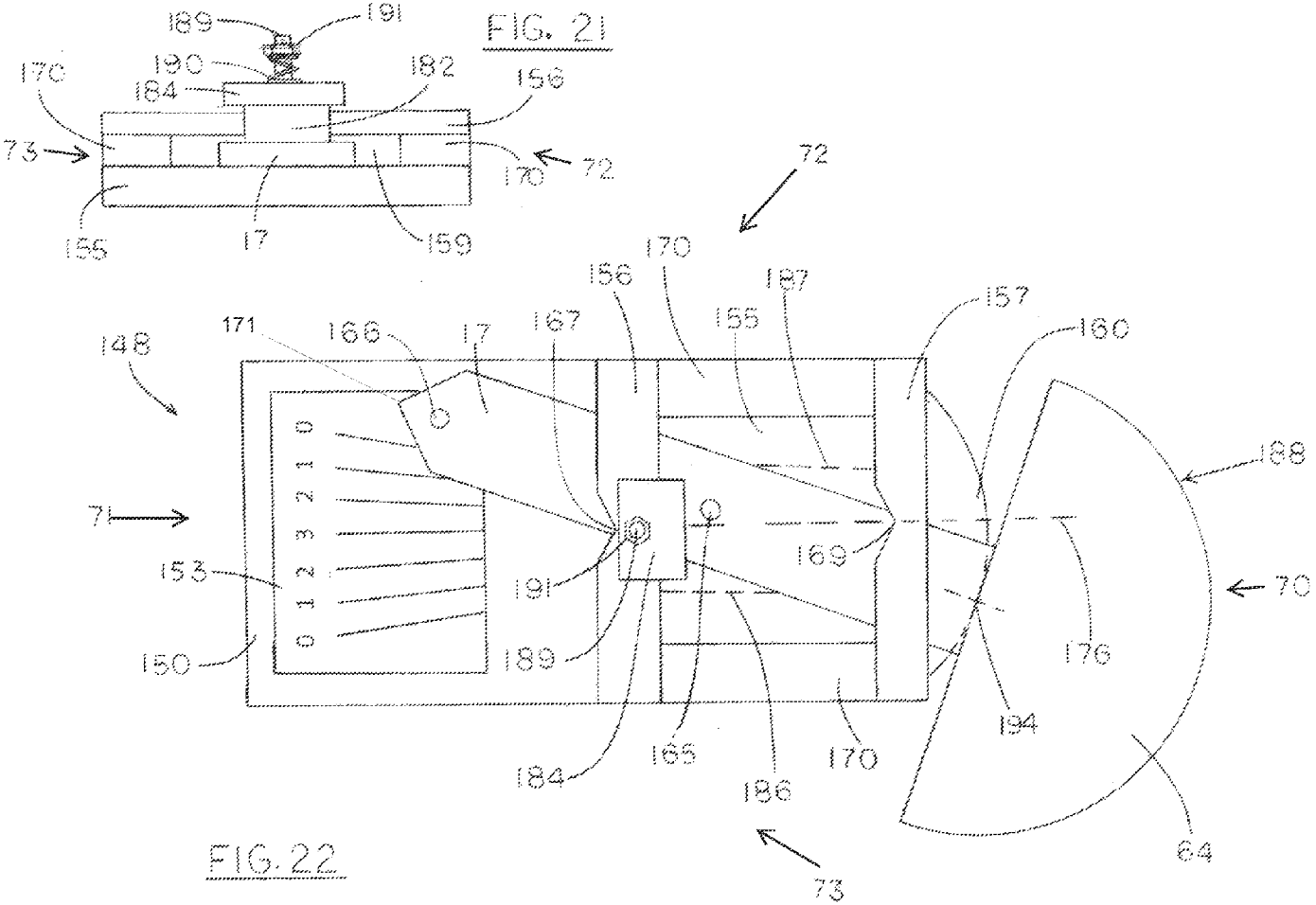
FIG. 21 is a front view of a damper used with the device of FIG. 18.
FIG. 22 is a top view of the device of FIG. 18 with the damper of FIG. 21.

As illustrated in FIG. 21, the device 10 may include a damper or a brake 182. The rubber damper 182 is connected to damper bracket 184 by a damper screw 189 and secured by a damper nut 191. The damper bracket 184 and the rubber damper 182 are moveably connected to rear cross bar 156. A damper spring 190 may be provided between the damper bracket 184 and the damper nut 191. The rubber damper 182 is located above the slot base 155 such that the direction pointer 17 may slide between the slot base 155 and the damper 182 as it slides in the rear slot 159.

Figure 20:
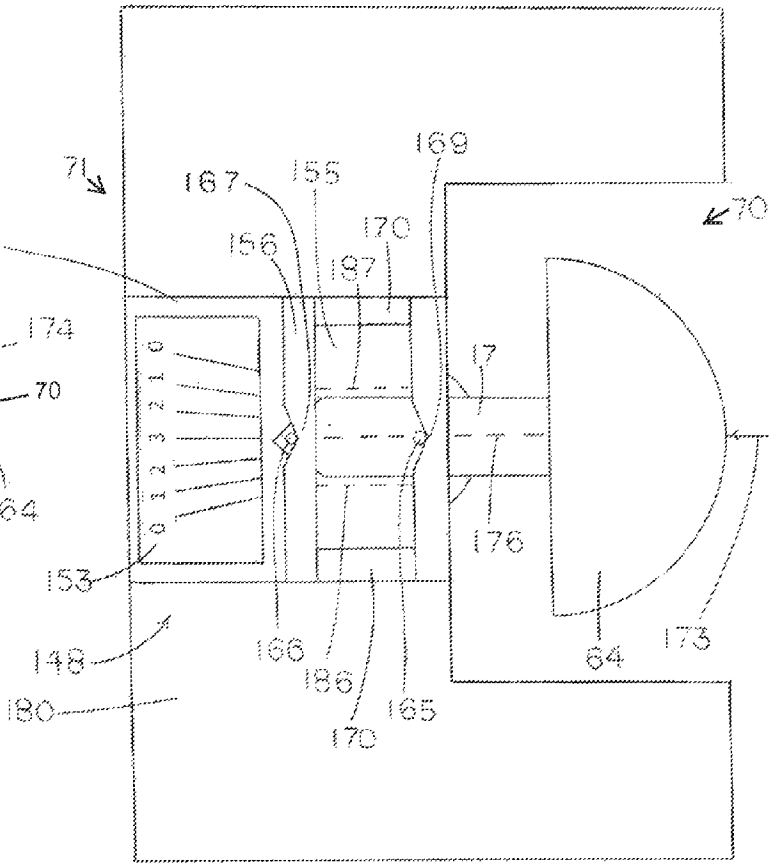

FIG. 20 shows a top view of a centered direction pointer 17 on top of slot base 155 under the front and rear cross bars 157, 156. The direction pointer 17 has a front centering pin 165 and a rear centering pin 166 located on a pre-kick centerline 176 of the direction pointer 17. A front centering notch 169 is located on the front cross bar 157 and a rear centering notch 167 is located on the rear cross bar 156. The centering notches 167, 169 align with the center pins 165, 166. The rear centering pin 166 is moved into and against the rear centering notch 167, and the front centering pin 165 moves into and against the front centering notch 169 at the same time, in order to align the ball 64 into a pre-kick center line 176 in preparation for a training kick.

FIG. 20 shows a right cross line 187 to the right of direction pointer 17 and a left cross line 186 to the left of direction pointer 17. Both cross lines 186, 187 are parallel to the centerline 176 of direction pointer 176 and can be seen when the direction pointer 17 is centered. The cross lines 186, 187 help to determine if a cross over kick occurs, as indicated by an arrow 188 (FIG. 22). An on-center kick, represented by arrow 173, will end with the direction pointer 17 engaging the rubber damper 182 at the centerline 176 and at the approximate center of a direction template 153.

Figure 19:
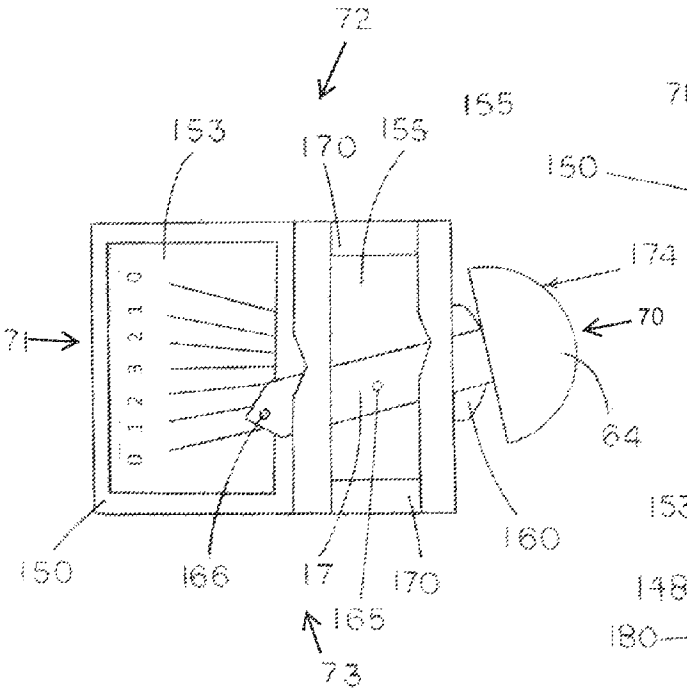
FIG. 19 is a detailed top view of the device in FIG. 18.

FIG. 19 illustrates the result of an off-center kick, indicated by an arrow 174. As illustrated in FIG. 19, the kick is made on the right side of the soccer ball 64 and parallel to center line 176. The ball 64 moves toward the left side 73 along with the direction pointer 17. FIG. 19 illustrates the direction pointer 17 pointing between the "0" and the "1" on the direction template 153. The direction template 153 illustrated in FIG. 19 has markings ranging from 0 to 3. After a kick, if the direction pointer 17 points near the 3, a generally straight kick has occurred. The markings of the illustrated embodiment have no significance relating to a particular on field kick other than a relative accuracy, as described above.

FIG. 22 shows the result of a cross-over kick 188 for a right footed kicker where the kick force 188 is at an angle with respect to the centerline 176 and at a distance to the right of the centerline 176. The cross-over force 188 initially moves the foam soccer ball 64 and direction pointer 17 in the direction of the arrow 188. As the back side of ball 64 impacts the curved bumper stop 160, the pointed tip 171 of the direction pointer 17 move back toward the right side 72, while the ball 64 remains on the left side 73 of the left cross line 186 or right cross line. This is illustrated by the cross-over kick tangent line 194 moving to the left of the centerline 176. Various parameters (e.g., kick angle, the curvature of bumper 160, etc.) may change the relative position of the direction pointer 17 and the ball 64 during cross-over kicks.

Figure 24:
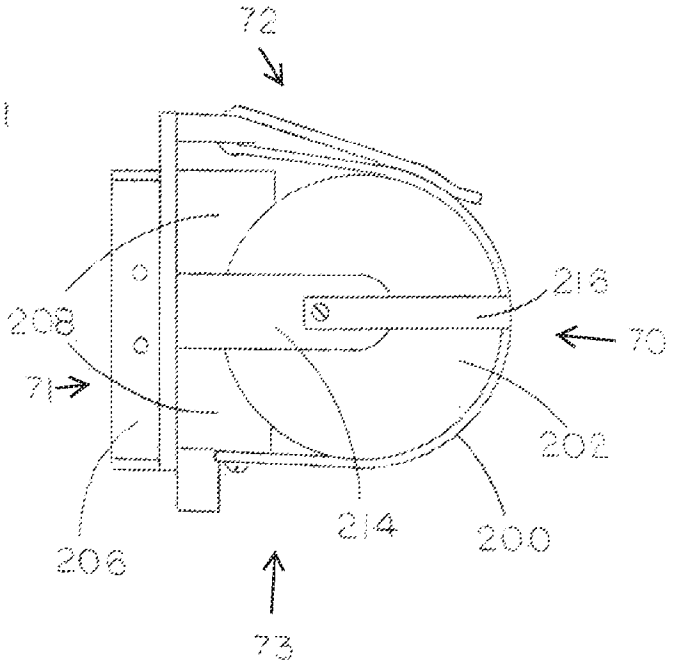
FIG. 24 is a top view of the ball holder assembly of FIG. 23.
Figure 23:
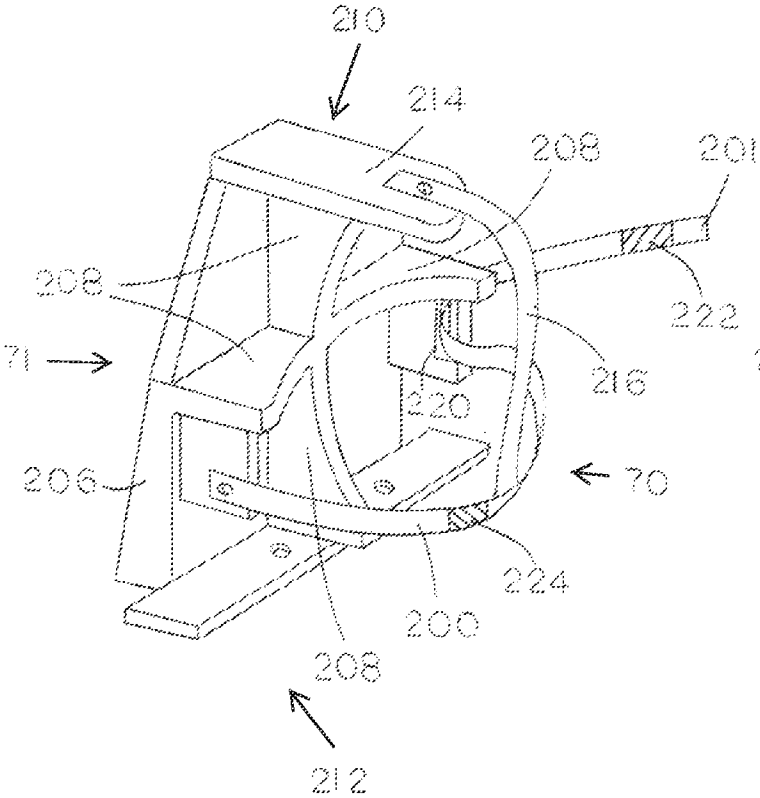
FIG. 23 is a perspective view of a ball holder assembly having straps.

FIGS. 23 and 24 illustrate ball holder 206 having a flexible strapping 200, which may be used to hold a regulation ball 202 (e.g., soccer ball, football, etc.). The ball holder 206 has four supports 208 extending from the ball holder 206, which are contoured to fit the shape of the ball 202. On the top side 210, there is a ball stop 214 extending forwardly to cover the top of ball 202.

The flexible strapping 200 is connected to the ball holder 206 on the left side and extends across the front side of an inserted ball 202. A rigid strap 216 is connected to the top of ball stop 214 and also connected to the flexible strap 200 near a midpoint to keep the flexible strap from moving up. The free end 201 of the flexible strapping 200 is fed through a slot 220 so that the strapping 200 may be pulled tight and fastened using Velcro portions 222, 224 on the strapping 200. The inserted ball 202 is secured in the ball holder 206 by the tightened the flexible strapping 200. The strapping 200 is easily loosened by disengaging the Velcro portions 222, 224.

Any of the previous embodiments or constructions of the device 10 may use the ball holder 206 to provide a real ball 202 for kicking. The ball holder 206 can be modified to hold various regulation balls (e.g., soccer ball, football, etc.) by changing the position and contour of the four supports 208 and the position of the ball stop 214. The ball holder 206 can be mounted by adding holes for mounting bolts, or any other known mounting technique.

During a typical kick using any of the previous embodiments, a user first sets up the device such that the ball and direction pointer 17 are centered at a front portion of the device. The user may then kick the ball, forcing both the ball and the pointer 17 to move from a start position (i.e., near the front) to a stop position (i.e., near the rear) in reaction to the force of the kick. As the ball and pointer 17 move from the front to the rear, the motion of the ball and the pointer 17 is slowed or stopped by various damping, braking, or bumper elements. After the pointer 17 and the ball come to rest, the relative position of the direction pointer 17 with respect to the direction template 153 is used to determine the angular accuracy and type of kick performed. The user may then re-set the device such that the ball and pointer 17 are centered for another kick.

Figure 25:
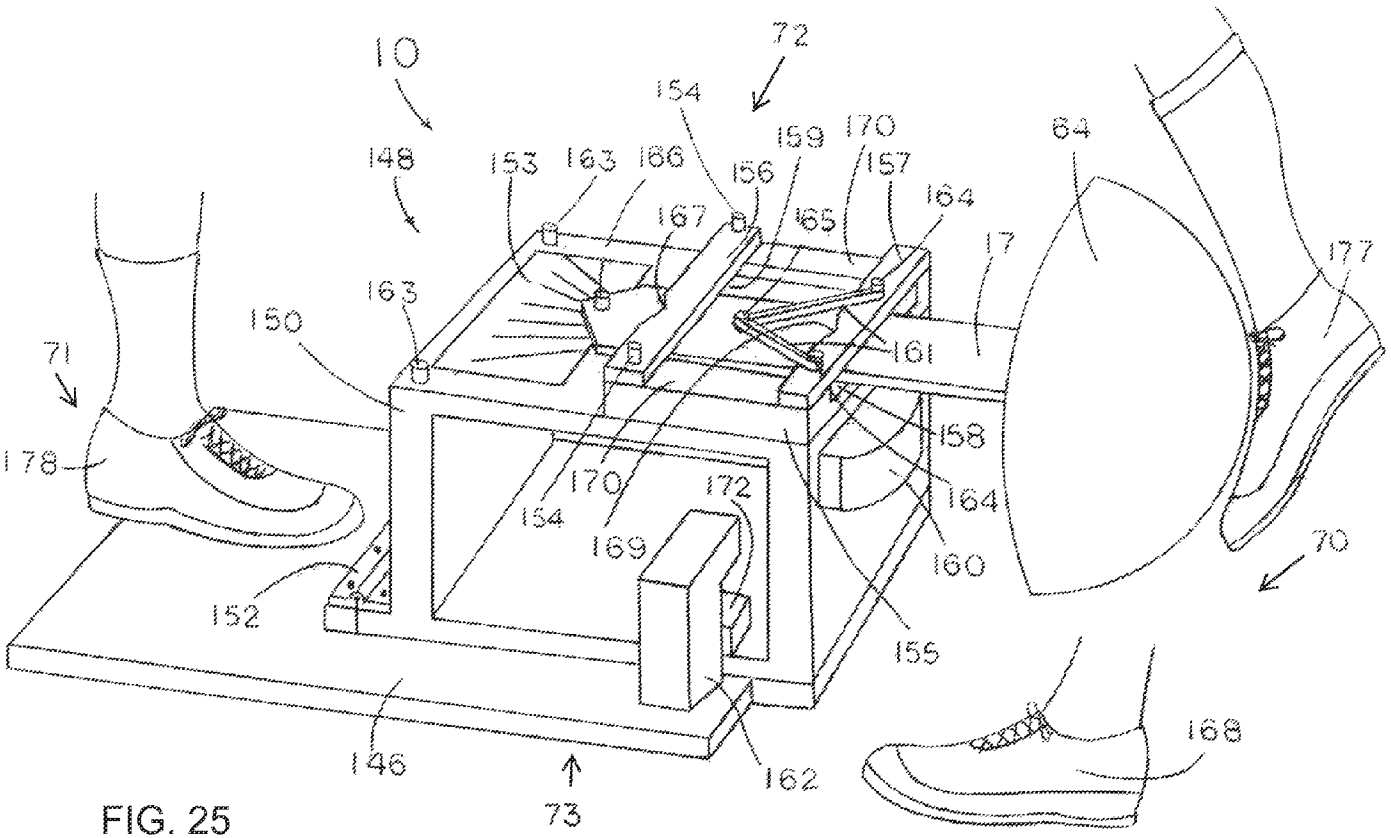
FIG. 25 is a perspective view of the device of FIG. 18 having elastic bands.

Alternatively, the device may include one or more elastic bands 161 to automatically re-set the device for another kick (FIG. 25). The elastic bands 161 are attached with one end to the front centering pin 165 and to stationary pins 164 with the other. The user may also use the rear centering pin 166 and middle stationary pins 154 for securing the elastic bands 161. When a user kicks the ball and it comes to a stop, the user then looks down at the direction template 153 before removing their foot from the ball 64. After the user gauges their accuracy, they can remove their foot, allowing the elastic bands 161 to pull the ball 64 and the direction pointer 17 back into the start position.

During a different kick drill, the ball 64 may be placed against the foam bumper, and the direction pointer 17 would not slide from the front to rear. The pointer 17 may still react to sideways movement caused by off-centered or cross-over kicks, but it may not be as sensitive as when the pointer 17 and the ball move from the front to the rear. The radius and shape of the foam bumper can minimize or maximize the movement of the direction pointer 17 when an off-center kick or cross-over kick is performed. Similar to FIG. 25, elastic bands 161 may be used to pull the ball 64 into engagement with the bumper 160 so that the ball stays in position and the user doesn't have to re-set the ball 64 after each training kick. The kicker can then practice repeated kicks while standing in place to maintain and improve locking his knee and ankle, or some other techniques.

Various features and advantages of the invention are set forth in the following claims.

What is claimed is:

1. A training device for measuring directional accuracy when performing a training kick, the device comprising:

a base adapted to be supported on a horizontal support surface and having a front side, a rear side, a right side, and a left side, the base including a front rod frame disposed at the front side of the base and a rear rod frame disposed at the rear side of the base, the left and right sides defining a side-to-side direction;

a guide rod coupled to the front rod frame and the rear rod frame such that the guide rod is restricted from vertical movement and free to move horizontally in the side-to-side direction;

a ball;

a linear bearing slidably connected to the guide rod;

a ball holder assembly coupled to the linear bearing to allow relative horizontal movement of the ball holder assembly while restricting vertical movement, the ball holder assembly holding the ball, and wherein the ball holder assembly and ball translate horizontally along the guide rod from the front side to the rear side and pivot relative to the base as the guide rod moves in the side-to-side direction such that after the ball is kicked the ball maintains a horizontal trajectory throughout the movement of the ball and ball holder assembly from the front side to the rear side;

a direction pointer coupled to one of the ball holder assembly and the ball, the direction pointer maintaining a parallel alignment with the guide rod as the direction pointer moves from the front side to the rear side and in the side-to-side direction; and a direction template in combination with the direction pointer indicating to a user the relative angular accuracy of the training kick after the training kick has been performed.

2. The training device of claim 1, further comprising an adjustable brake assembly configured to engage the direction pointer during the training kick, the adjustable brake assembly including a plurality of brake pads, wherein pressure on the brake pads against the direction pointer can be adjusted to adjust the distance the direction pointer travels into the brake assembly.

3. The training device of claim 1, further comprising a platform engageable with the training device to provide a kicking surface, and further comprising a walkway assembly engageable with the platform as an extension of the platform for the user to walk on as the user approaches the ball before the kick.

4. The training device of claim 1, wherein the ball defines a portion of a football or soccer ball.

5. The training device of claim 1, further comprising a brake assembly that engages the direction pointer.

6. The training device of claim 1, wherein the direction pointer includes at least one of a point or an indicator line centrally located between the sides of the direction pointer, wherein the at least one of a point or an indicator line aligns with a marking on the direction template when the ball holder assembly moves to the rear side after the ball is kicked to visually indicate the relative angular accuracy of the kick.

7. The training device of claim 1, wherein the base includes a bottom panel, and wherein the ball holder assembly includes a carriage assembly including wheels supported by the bottom panel as the ball holder assembly moves from the front side to the rear side.

* * * * *